US007895966B2

(12) United States Patent
Saul

(10) Patent No.: US 7,895,966 B2
(45) Date of Patent: Mar. 1, 2011

(54) INDICATOR CAP FOR GAS CYLINDERS

(76) Inventor: Peter Saul, Carlisle, MA (US)

( * ) Notice: Subject to any disclaimer, the term of this patent is extended or adjusted under 35 U.S.C. 154(b) by 985 days.

(21) Appl. No.: 11/788,207

(22) Filed: Apr. 19, 2007

(65) Prior Publication Data

US 2008/0017641 A1 Jan. 24, 2008

Related U.S. Application Data

(60) Provisional application No. 60/793,600, filed on Apr. 20, 2006.

(51) Int. Cl.
*G09F 3/00* (2006.01)

(52) U.S. Cl. ..... 116/200; 74/558.5; 40/310

(58) Field of Classification Search ..... 116/277, 116/200, 1; 40/306, 307, 310, 311, 331, 40/332, 299.01, 5; 206/459.1; 74/558, 558.5
See application file for complete search history.

(56) References Cited

U.S. PATENT DOCUMENTS

| | | | | | |
|---|---|---|---|---|---|
| 431,290 | A | * | 7/1890 | Synder et al. | 40/5 |
| 2,573,042 | A | * | 10/1951 | Minovitz | 40/332 |
| 2,703,546 | A | * | 3/1955 | Allen | 116/200 |
| 3,787,993 | A | | 1/1974 | Lyon | |
| 3,910,308 | A | * | 10/1975 | Mack | 137/553 |
| 4,058,081 | A | | 11/1977 | Maxfield | |
| 4,149,329 | A | * | 4/1979 | Graves | 40/668 |
| 4,165,659 | A | | 8/1979 | Fawley | |
| 4,257,342 | A | * | 3/1981 | Ditto | 116/307 |
| 4,549,568 | A | | 10/1985 | Trail | |
| 4,680,882 | A | * | 7/1987 | Watson, Jr. | 40/5 |
| 4,999,875 | A | * | 3/1991 | Rybak | 16/432 |
| 5,035,195 | A | * | 7/1991 | Wille | 116/277 |
| D333,617 | S | | 3/1993 | Brown | |
| 5,377,853 | A | | 1/1995 | Papciak | |
| 5,497,879 | A | | 3/1996 | Kao | |
| 5,730,292 | A | | 3/1998 | Jones | |
| 5,775,019 | A | | 7/1998 | Johnson | |
| 5,943,741 | A | * | 8/1999 | Furutsu | 24/16 PB |
| 6,112,619 | A | | 9/2000 | Campbell | |
| 6,123,187 | A | * | 9/2000 | Bartels | 206/0.6 |
| 6,336,422 | B1 | | 1/2002 | Peters | |
| 6,450,355 | B1 | | 9/2002 | Lowry | |
| 6,854,616 | B2 | | 2/2005 | Steffan | |

(Continued)

FOREIGN PATENT DOCUMENTS

| | | | |
|---|---|---|---|
| EP | 326039 | A1 * | 8/1989 |

*Primary Examiner*—R. A. Smith
(74) *Attorney, Agent, or Firm*—Hamilton, Brook, Smith & Reynolds, P.C.

(57) ABSTRACT

A tank handle or cap is designed for the convenience of the consumer. One aspect of the invention cap allows the end user to determine at a glace and from a distance if the tank is full or empty based on color distinction and/or word imprints on different sides (halves) of the invention cap. The cap is removably securable to the tank in different orientations to effectively expose the telling side of the invention cap. This allows the user the ability not to have to go over to the tank and lift the tank to gauge if the tank is full or not. This will reduce the risk of possible back injury. Other design features include an easy-to-use grip and open and close directional indicators to allow clear and concise understanding and operation of tank valves.

20 Claims, 5 Drawing Sheets

U.S. PATENT DOCUMENTS 6,886,577 B1 5/2005 Phillips et al.
6,968,968 B2 11/2005 Buckley et al.
7,194,829 B2 * 3/2007 Boire et al. ..... 40/316
7,438,085 B2 * 10/2008 Ratermann ..... 137/379
2010/0229436 A1 * 9/2010 Zeyfang ..... 40/306

* cited by examiner

INDICATOR CAP FOR GAS CYLINDERS

RELATED APPLICATION

This application claims the benefit of U.S. Provisional Application No. 60/793,600, filed on Apr. 20, 2006.

The entire teachings of the above application are incorporated herein by reference.

BACKGROUND OF THE INVENTION

Propane gas cylinders of about 50 lbs. or so are used in residential settings. A common problem of such use is the inability to visually determine whether a subject cylinder/tank is empty or full. Similarly, other types of cylinders and tanks (typically made for homeowner use) lack gauges, visual indicators, and the like indicating level of contents (e.g., empty versus full).

SUMMARY OF THE INVENTION

A cap secures over a three spoke propane tank cylinder handle. The handle is found on 50 lbs. cylinders typically used for home use of propane gas. The cap is made of a pliable product (plastics or rubber) to allow the end user the ability to remove, turn over, and then replace the cap (now in an opposite or generally in one of two orientations) as the tank becomes empty or each time the tank is refilled. Embodiments have legible printing on each side to tell the user which direction to turn the cap to close the cylinder flow of gas. One direction is marked "open" with an arrow pointing in a direction indicating how to turn the handle to open the valve and start gas flow. Likewise, the cap is marked with "close" and an arrow pointed in the opposite direction indicating the direction to turn the handle to close the flow of gas.

In particular embodiments, the cap has ribs along the outside to allow a better grip when turning off and on the valve. In an embodiment, the cap has a distinct color labeled for each side (orientation). One side, for example, is colored green and is labeled "FULL." The other side is red and is labeled "EMPTY."

In one embodiment, a cap for cylindrical tank has one side (orientation) that visually indicates the contents of the tank being at or near full capacity of the tank. The cap also includes an opposite side (orientation) that visually indicates the tank is empty. Each orientation of the cap is removably settable with respect to the tank, but while the cap in one orientation is removably secured to the tank, the operative side of the opposite orientation is not viewable.

In another embodiment, the user removably secures a cap to a tank. In the secured position, the cap has a front facing portion and a back facing portion. The front facing portion bears an indicator indicating the contents of the tank being at or near full capacity of the tank.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of preferred embodiments of the invention follows.

Figure 1:
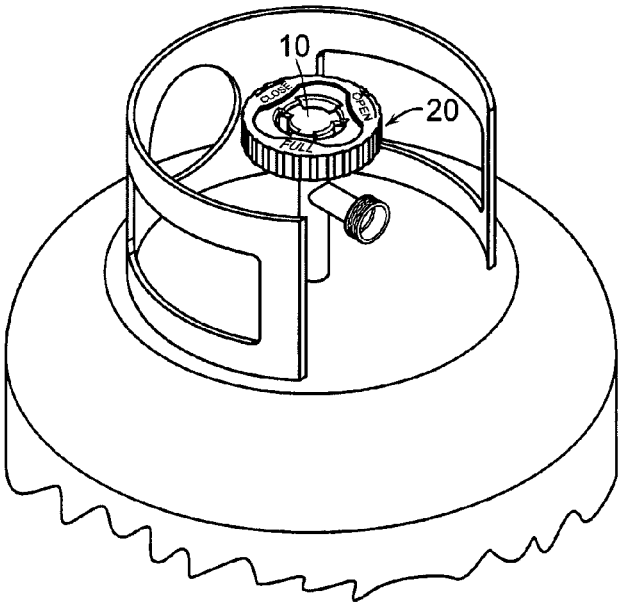
FIG. 1 is an elevation view of a cap or handle cover embodiment of the present invention in place on a propane tank handle.
Figure 2:
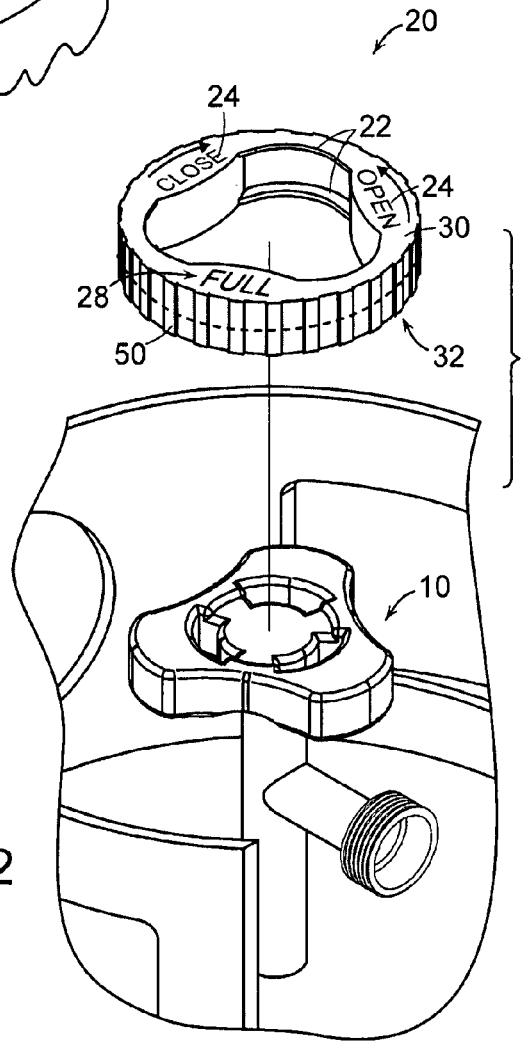
FIG. 2 is an exploded view that shows how an embodiment is placed on the handle of the propane tank.
Figure 4:
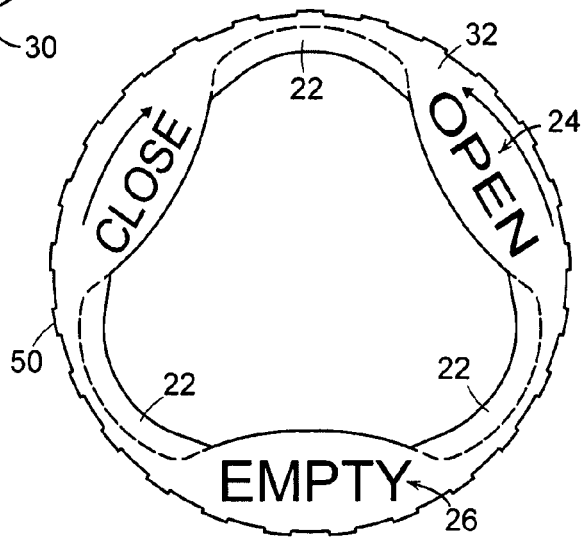
FIG. 4 is a top view of the EMPTY indicating side of the cap of FIG. 1.

FIG. 1 shows a cap 20 (e.g., a handle cover) on a propane tank handle 10. In use, a user places the cap 20 on the propane tank handle 10 as shown. For example, a donut shaped design of the cap 20 that is placed over a three pronged propane tank handle 10 is shown in FIG. 2. Further, the cap 20 includes ridge grips 50 around the outside circumference allowing for better gripping when rotating the cap. The cap 20 also has two visually distinct sides. More specifically, one side 30 is color-coded, preferably GREEN, and imprinted with an indicator (e.g., FULL 28). Moreover, the one side 30 includes the word OPEN 24 with a direction arrow and the word CLOSE 24 with an opposite direction arrow indicating how to operate a tank valve. The other side 32 (e.g., opposite side) is also color-coded, preferably RED, and is imprinted with the indicator EMPTY 26 (FIG. 4). The other side 32 also includes OPEN 24 and CLOSE 24 labels with directional respective arrows. It is useful to note that the indicator 26, 28 may also be a symbol, such as a recognized representation for FULL or EMPTY.

In a convenient embodiment, for each orientation illustrated in FIGS. 2 and 4, the cap 20 is pressed down over the three pronged propane tank handle 10 until lower flexible fins 22 snap under each prong of the tank handle 10. The upper and lower fins 22 hold the cap 20 in place on the tank handle 10. In this way, a user can removably secure the cap 20 in the appropriate and desired orientation (FULL 28 indicator side up or EMPTY 26 indicator side up), and thereafter be able to visually recognize the indicator (e.g., FULL 28 or EMPTY 26) on the propane tank by viewing the cap 20 (i.e., at a glance).

Figure 3:
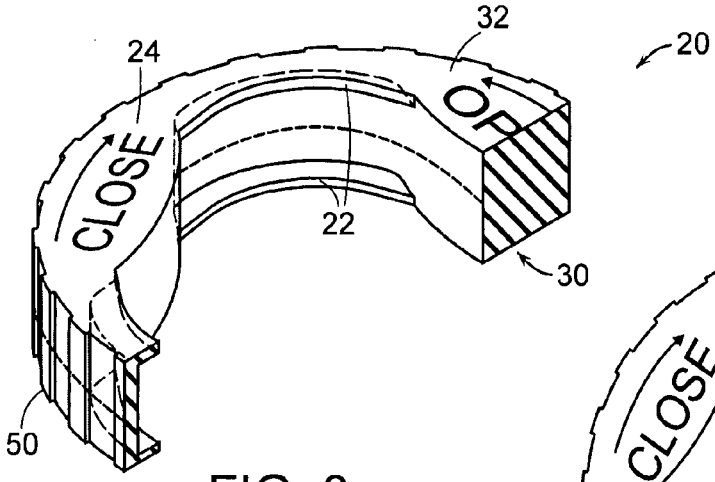
FIG. 3 is a sectional view of the cap embodiment of FIG. 1.
Figure 5:
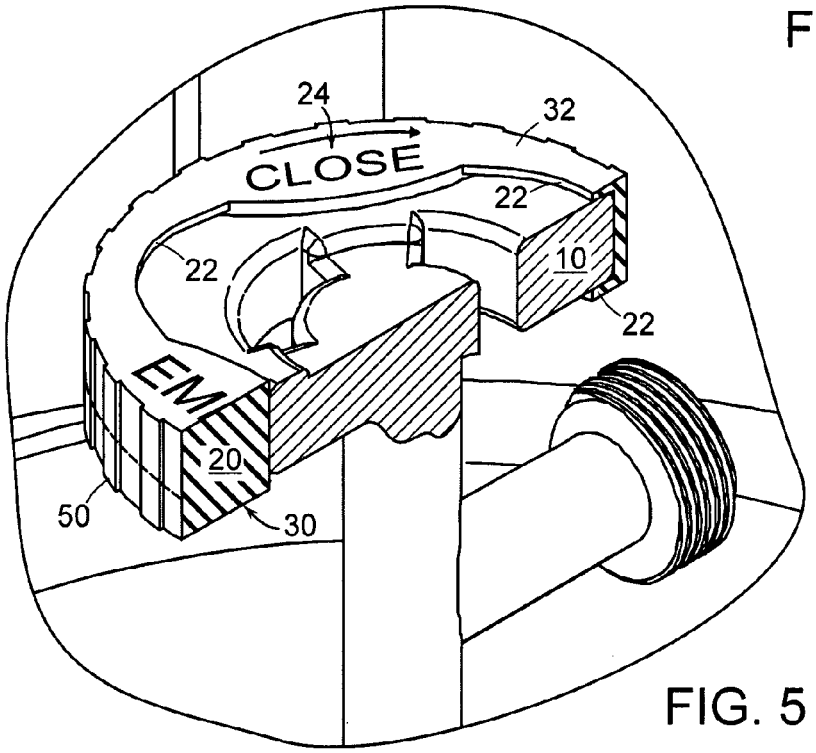
FIG. 5 is a cross section view of the FIG. 1 cap in place on a propane tank handle.

Shown in FIGS. 3-5 is a cross section view of cap 20 (FIG. 3), a top view of the EMPTY 26 indicating side 32 (FIG. 4), and a cross sectional view of the cap installed on the propane tank handle 10 (FIG. 5). More accurately, FIGS. 3-5 show details of the indicators OPEN 24, CLOSE 24, and EMPTY 26. From the cross sectional view of FIG. 3, one can distinguish between the EMPTY indicating side 32 (a red side in one embodiment) and the FULL indicating side 30 (a green side in one embodiment). Also shown in detail are ridges 50 allowing for a better grip for a user. Moreover, the flexible upper and lower fins 22 are seen in FIG. 3 and FIG. 5. The flexible fins 22 secure the cap 20 to a three (or any number) pronged tank handle 10. The relationship between the flexible fins 22 and the multi-pronged tank handle 10 is shown in FIG. 5.

In use, the user removably secures cap 20 FULL 28 indicia side 30 up (e.g., green side 30 up) onto tank handle 10 of a full propane tank. This is accomplished by respectively orienting cap 20 (side 30 up) and snapping cap 20 over or pressing the cap 20 onto the tank handle 10. After use of the contents of the tank, i.e., when the tank is effectively empty of its contents, the user lifts cap 20 off tank handle 10 and changes orientation of cap 20. That is, the user flips cap 20 over to bear opposite (red) side 32. now with EMPTY indicator 26 (red) side 32 up, the user applies (presses) cap 20 onto the tank handle 10 removably securing cap 20 in its new orientation. As a result, cap 20 now at a glance (readably visually) indicates that the subject tank is empty and the user can easily avoid attempting to use contents from the tank. Instead, the convenient cap indicators let the user know, again at a glance and without lifting the tank, that the tank needs refilling or replenishing of contents. Once the user refills the tank the user reasserts cap 20 to be removably secured on handle 10 in the orientation reading "FULL" and so on.

Figure 6:
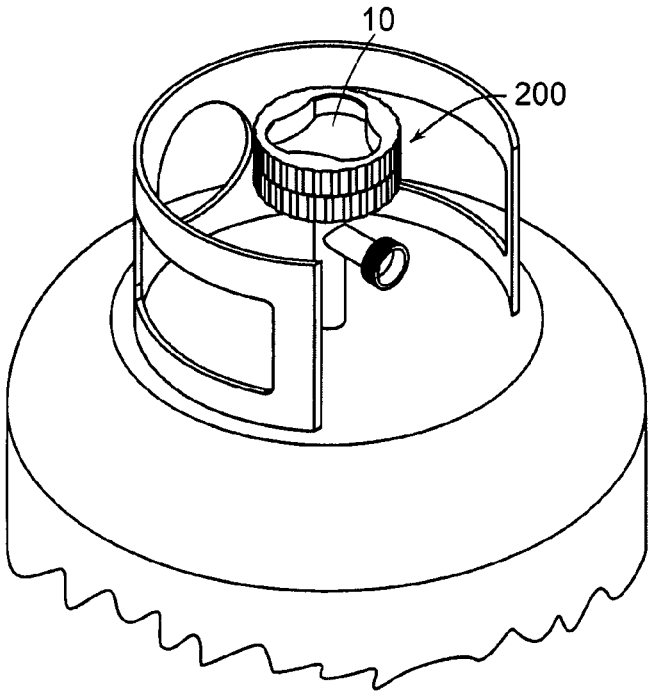
FIG. 6 is an elevated view of another embodiment as it would appear in place on a propane tank handle.
Figure 7:
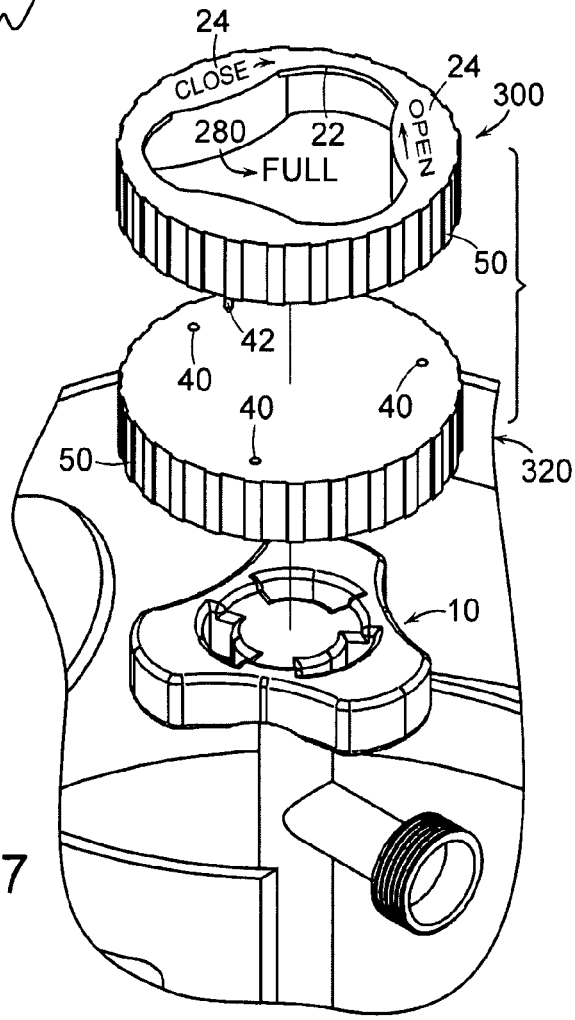
FIG. 7 is an exploded view on how the FIG. 6 embodiment snaps together to form one unit that is then placed on the propane tank handle.
Figure 8:
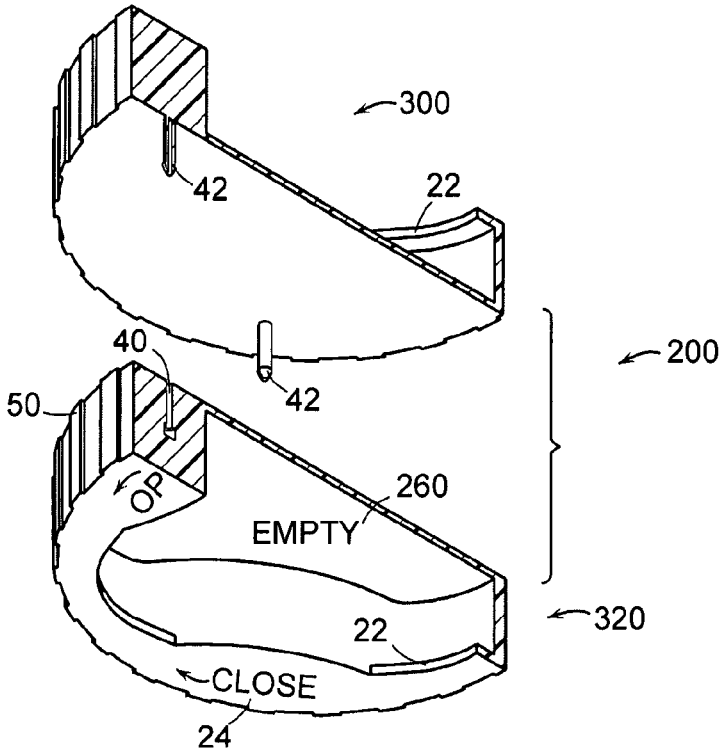
FIG. 8 is a cross section of both halves of the embodiment of FIG. 7 before assembly.

FIGS. 6-8 show a cap embodiment assembled in two components, where one component 300 (a green piece) indicates FULL 280 and the other component 320 (a red piece) indicates EMPTY 260. Both components are shaped like a bowl with the FULL 280 component 300 having pencil-like prongs 42 with ridges on the ends protruding from a bottom side. Similarly, EMPTY 260 component has holes 40 having a ridge inside that receives prongs 42. To make the cap 200 ready for use, the prongs 42 of component 300 are snapped into respective receiving holes 40 of component 320. Once the components 300, 320 are snapped together, both components during use in this manner, they will not separate from each other during cap 200 use. An additional benefit of snapping the components 300, 320 together is ridges 50 are formed, by way of the cap assembly, resulting in a more comfortable grip. Further, the cap 200 also includes CLOSE 24 and OPEN 24 indicators with respective directional arrows for providing to a user operating instruction for the valve. Moreover, on the green component 300, the indicator "FULL" 280 is imprinted on the bottom of a bowl shaped surface. On its counterpart, the red color component 320, the indicator "EMPTY" 260 is similarly imprinted on the respective bottom of the bowl surface of component 320.

Figure 9:
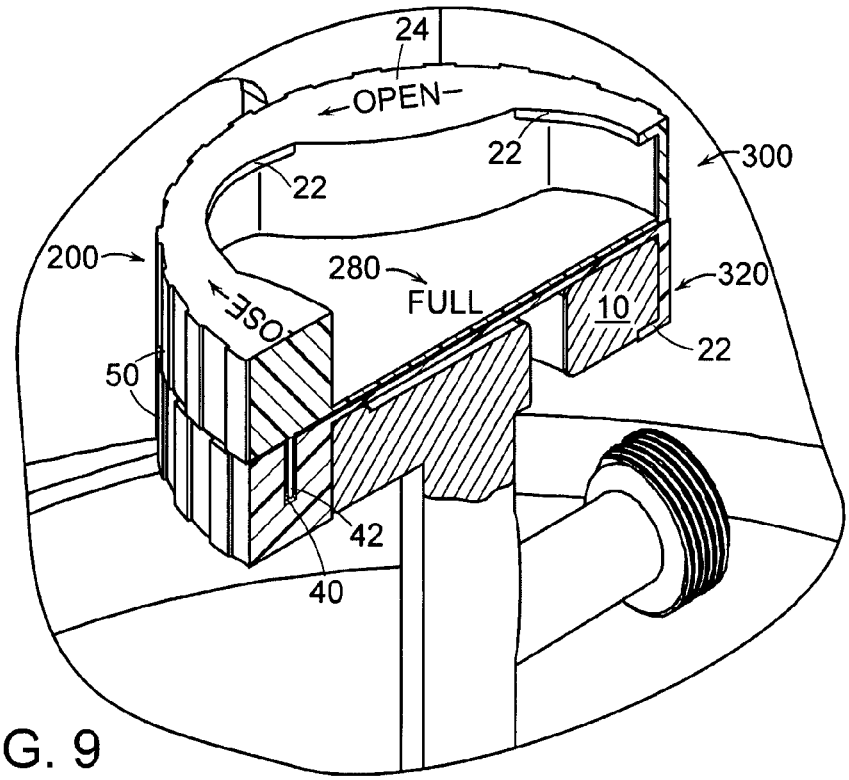
FIG. 9 is a cross section of the embodiment of FIG. 7 assembled and in place on a propane tank handle.

For further convenience, each component 300, 320 includes flexible fins 22 as shown in the cross sectional of FIGS. 8-9. The flexible fins 22 are used to removably secure a cap 200 to a tank handle 10, in the desired one of two orientations at a time, in the manner describe above for cap 20 in FIGS. 1-5. For example, FIG. 9 shows how the fins 22 snap under the tank handle 10 to temporarily securely hold the cap 200 in place (i.e., in removably secure fashion).

Figure 10:
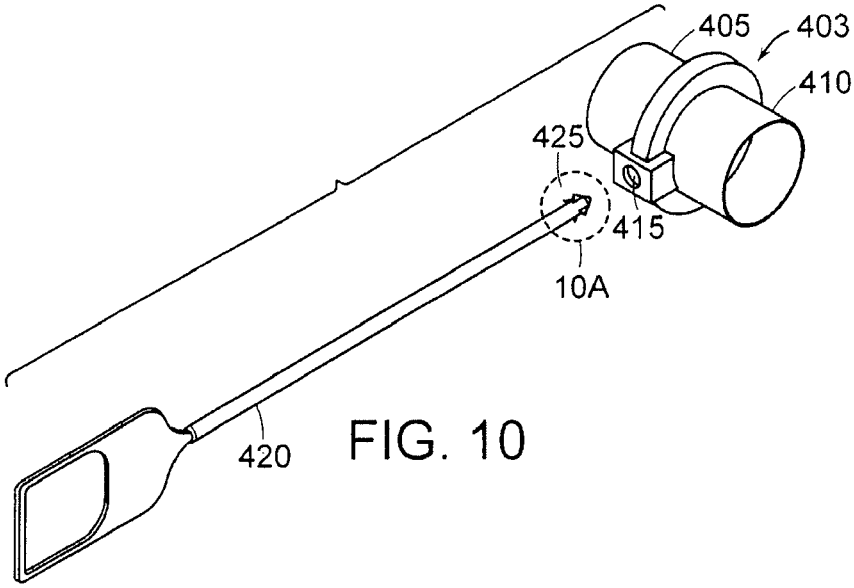
FIG. 10 is a partially exploded view of an alternative embodiment of a cap used as a visual indicator.
Figure 12:
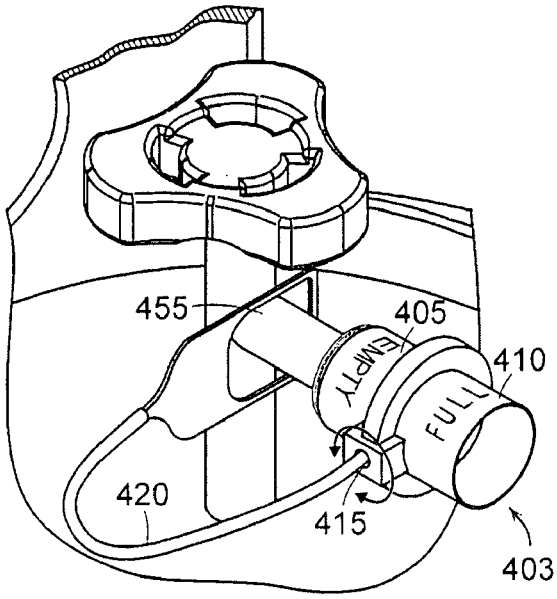
FIG. 12 is a perspective view of the FIG. 10 embodiment places on a valve of the propane tank.

FIG. 10 represents an alternative embodiment of a visual indicator cap 403. In particular, the cap 403 includes a first half 410 or first portion, a second half 405 or second portion, and a receiving inlet 415. In FIG. 12 for purposes of illustration, the first half 410 is shown forward facing and includes indicia (e.g., FULL) in proper reading orientation for a user to determine, at a glance, whether the contents of the tank are near full. The second half 405 is shown backwards facing and includes indicia (e.g., EMPTY) that is not in proper reading orientation when the cap 403 is positioned with the first half 410 facing out. As will be further described below, depending on orientation (position/placement) of cap 403 on a subject tank, one of the two halves 405, 410 will be outward facing and in proper reading orientation to indicate respective contents level (empty or full) of the tank.

Figure 10A:
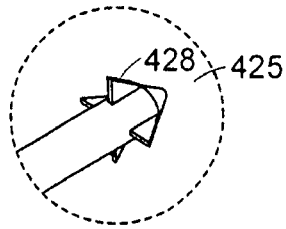
FIG. 10A is a close-up view of a swivel connector.
Figure 11:
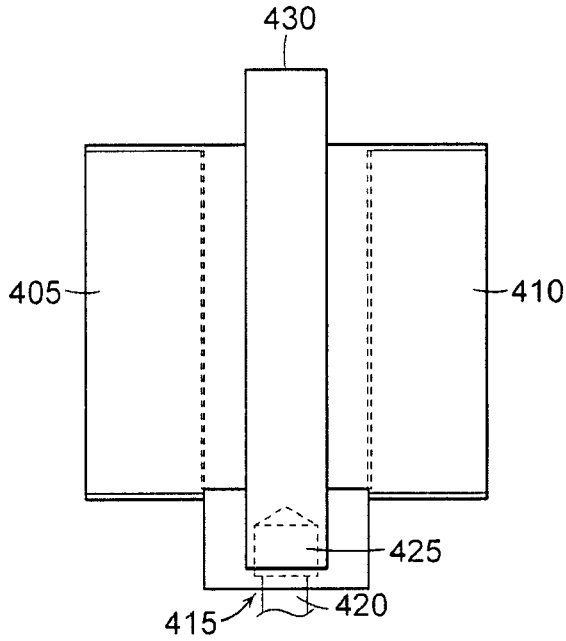
FIG. 11 is a top-view of the FIG. 10 embodiment shows a connection of a receiving inlet and swivel connector.

Also shown is a strap 420, which includes a swivel connector 425 at a distal end. The swivel connector 425 is adapted to cooperate with the receiving inlet 415 so as to form a rotatable connection with cap 403. A close-up view of the swivel connector 425 is shown in FIG. 10A. The swivel connector 425 also provides a fastened connection by using flexible fins 428. The flexible fins 428 protrude into the receiving inlet 415 of FIG. 10 and secure the swivel connector 425 to the cap 403. A top-view of the connection (strap 420 connected to cap 403) is shown in FIG. 11. First half 405 and second half 410 are shown on either side of a ring 430, and the ring 430 couples receiving inlet 415 to cap 403. The receiving inlet 415 receives swivel connector 425 to form a rotatable connection.

The swivel connector 425 provides a rotational movement of about 360 degrees within receiving inlet 415. The rotational movement allows the strap 420 and cap 403 to rotate relative to each other and to change angular position, relative to each other, about a longitudinal axis. For example, cap 403 rotates, using the swivel connector 425, to reverse the position of the first half 410 and the second half 405. That is, the first half 410 can be moved (repositioned) to be backwards facing and the second half 405 becomes forward facing. As a result, the indicia (e.g., EMPTY) of the second half 405 moves to a proper reading orientation and the indicia (i.e., indicator) of the first half 410 is consequently placed in a non-readable orientation as desired by the user.

FIG. 12 shows cap 403 placed over a tank valve, orifice, or other opening 455. In a preferred embodiment, the cap 403 includes a first cup-shaped half 410 that is color-coded, preferably GREEN, and imprinted with the indicator FULL 28. A second. cup-shaped half 405 is also color-coded, preferably RED, and is imprinted with the indicator (a word, symbol or other indicia) EMPTY 26. At one end, strap 420 connects to the tank valve 455. At the other end, the strap 420 attaches to receiving inlet 415 in rotational freedom fashion described above. By attaching the distal end of strap 420 to the receiving inlet 415, the strap 420 secures (tethers) the cap 403 to the tank valve 455 and also enables the cap 403 to be rotatable by a user at the receiving inlet 415. For example, a user may remove the cap 403 from the tank valve 455 and swivel, pivot, or rotate the cap 403 to be in the reverse direction (orientation). That is, the user rotates the first half 410 from forward facing to backwards facing (i.e., towards the stem of the tank valve 455) and the second half 405 from backwards facing to forward facing (i.e., away/outward from the tank). After rotating the cap 403, the user places the cap 403 over the tank valve 455 opening where the indicia (e.g., EMPTY) of the second half 405 is in proper reading orientation. To aide a user in removably securing the cap 403 over the tank valve 455 opening, the cap 403 (cup halves 405, 410) is made of internal dimensions and material that allows a comfortable loose fit over such opening. It is useful to note that the cap 403 may be two separate pieces that are snapped together in the same manner as described in FIGS. 6-8 above.

It should be understood that any of the embodiments disclosed herein, such as the cap of FIG. 1 or FIG. 10, may be implemented without the use of sensors (e.g., sensor-less) or electronics. If implemented without the use of sensors, a user may manually position/reposition the cap.

While this invention has been particularly shown and described with references to preferred embodiments thereof, it will be understood by those skilled in the art that various changes in form and details may be made therein without departing from the scope of the invention encompassed by the appended claims.

For example, in addition to the above retrofit type caps/handle covers, initial handles manufactured with the tank stem may incorporate the principles of the present invention. A releasable and reversible (top to bottom side up and vice versa) cap may incorporate the color scheme and FULL/EMPTY coordinating indicia as described above and shown in the drawings.

Although the above description refers to propane tanks, the present invention cap is useable on other tanks, refillable containers and the like of various contents.

What is claimed is:

1. A cap for a cylindrical tank comprising:

one side that effectively visually indicates contents of a tank being at or near full capacity of the tank, and an opposite side that effectively visually indicates that the tank is empty, the one side being removably securable to a handle of the tank, and the opposite side being removably securable to the handle of the tank when the one side is not secured to the tank by;

the cap defining an aperture configured to receive the handle of the tank, there being a plurality of fins disposed along an edge of the aperture, the fins providing snap-on fitting of the cap onto the handle.

2. A cap as claimed in claim 1 wherein the one side and the opposite side are each shaped to be retrofit over and receive a tank orifice.

3. A cap as claimed in claim 1 wherein the one side and the opposite side are each shaped to be retrofit over and receive a tank valve.

4. A cap as claimed in claim 1 wherein the one side and the opposite side are color-coded.

5. A cap as claimed in claim 1 wherein the one side is colored or labeled differently than the opposite side.

6. A cap as claimed in claim 1 wherein the one side and the opposite side effectively visually indicate at reading distance or greater.

7. A cap as claimed in claim 1 wherein the one side and opposite side effectively visually indicate a level of contents of the tank using a word, color, or symbol.

8. A cap as claimed in claim 1 further comprising ridges disposed along an outer circumference of the cap.

9. A cap as claimed in claim 1 wherein the one side is formed by a first component and the other side is formed of a second component coupled to the first component.

10. A cap as claimed in claim 9 wherein the first component is coupled to the second components with a plurality of prongs.

11. A method for indicating a tank level of contents relative to capacity comprising:

removably securing a cap to a tank handle by snap-on fitting the cap to the tank handle within an aperture defined by the cap, there being a plurality of fins disposed along an edge of the aperture, the fins providing the snap-on fitting of the cap onto the handle, where the cap includes a first portion, a second portion, and a respective indicator for each of the first and second portions; and indicating level of the contents of the tank being at or near full capacity of the tank using the indicator on the first portion of the cap by positioning the cap on the tank handle in a manner that results in (i) the indicator on the first portion being in a proper reading orientation and (ii) the indicator on the second portion being in a non readable orientation.

12. A method as claimed in claim 11 further comprising:

indicating a level of the contents of the tank being at or near empty using the indicator on the second portion of the cap by positioning the cap on the tank in a manner that results in:

the indicator or the second portion being in a proper reading orientation; and the indicator of the first portion being in a non-readable orientation.

13. A method as claimed in claim 11 wherein the first portion and second portion are each shaped to be retrofit over and receive the tank handle.

14. A method as claimed in claim 11 wherein the first portion and second portion are color-coded.

15. A method as claimed in claim 11 wherein the first portion is colored differently than the second portion.

16. A method as claimed in claim 11 wherein the indicator on the first portion effectively indicates a full tank, and wherein the indicator on the second portion effectively indicates the tank is empty.

17. A method as claimed in claim 11 wherein the first portion and the second portion effectively visually indicate contents level at reading distance or greater.

18. A method as claimed in claim 11 wherein the first portion and the second portion effectively visually indicate contents of the tank using a word, color, or symbol.

19. A cap for a cylindrical tank comprising:

a first cylindrical half that effectively visually indicates contents of a tank being at or near full capacity of the tank;

a second cylindrical half, disposed opposite the first cylindrical half, that effectively visually indicates that the tank is empty;

a ring disposed between the first and second cylindrical halves and configured to be removably securable to an orifice of the tank in a first configuration with the first cylindrical half oriented in a proper reading orientation and in a second configuration with the second cylindrical half oriented in a proper reading orientation; and a strap configured to tether the cap to the tank.

20. A cap as claimed in claim 19 wherein the strap includes a swivel connector that forms a rotatable connection with the ring.

* * * * *

UNITED STATES PATENT AND TRADEMARK OFFICE

CERTIFICATE OF CORRECTION

PATENT NO. : 7,895,966 B2
APPLICATION NO. : 11/788207
DATED : March 1, 2011
INVENTOR(S) : Peter Saul It is certified that error appears in the above-identified patent and that said Letters Patent is hereby corrected as shown below:

In Column 5, Claim 1, Line 23, please delete ";" and insert -- : --.

Signed and Sealed this
Fifth Day of April, 2011

David J. Kappos

David J. Kappos
*Director of the United States Patent and Trademark Office*